United States Patent [19]

Callecod

[11] 4,159,113

[45] Jun. 26, 1979

[54] CHILD RECREATION STRUCTURE

[75] Inventor: Robert L. Callecod, Long Lake, Minn.

[73] Assignee: Recreation Systems Co., Aurora, Ill.

[21] Appl. No.: 693,012

[22] Filed: Jun. 4, 1976

[51] Int. Cl.[2] ..... A63B 17/00

[52] U.S. Cl. ..... 272/113; 104/113; 272/56.5 R; 272/85; 104/112

[58] Field of Search ..... 272/93, 113, 70, 112, 272/115, 114, 109, 60; 104/87, 89, 93, 118, 112, 125; 242/100; 211/119.01; 182/194, 196; 14/76

[56] References Cited

U.S. PATENT DOCUMENTS

| | | | |
|---|---|---|---|
| 806,401 | 12/1905 | Dawson | 211/119.01 |
| 1,765,361 | 6/1930 | Berman | 272/113 |
| 1,873,196 | 8/1932 | Harris et al. | 104/112 |
| 1,914,555 | 6/1933 | Connelly | 272/109 |
| 2,843,379 | 7/1958 | Merritt | 272/113 X |
| 3,090,617 | 5/1963 | Hjelte et al. | 272/112 X |
| 3,764,446 | 10/1973 | Martin | 272/109 X |

FOREIGN PATENT DOCUMENTS

| | | | |
|---|---|---|---|
| 2348125 | 9/1975 | Fed. Rep. of Germany | 272/112 |
| 1369440 | 7/1964 | France | 14/76 |

*Primary Examiner*—Richard C. Pinkham
*Assistant Examiner*—William R. Browne
*Attorney, Agent, or Firm*—Darbo & Vandenburgh

[57] ABSTRACT

A steel cable is stretched overhead between a starting platform and a terminal tower and equipped with a passenger pulley having a handle from which a child can hang while rolling along the cable. Only difficultly negotiable ladder means e.g., a chain or tire ladder, are provided for climbing to the starting platform to limit access to the starting platform to children having motor skills that are sufficiently developed to ensure safe use of the cable slide. An impact cushion may be mounted upon the terminal tower below the cable. Auxiliary recreational facilities are provided in the same structures to entertain children awaiting their turns and those who are interested observers.

5 Claims, 12 Drawing Figures

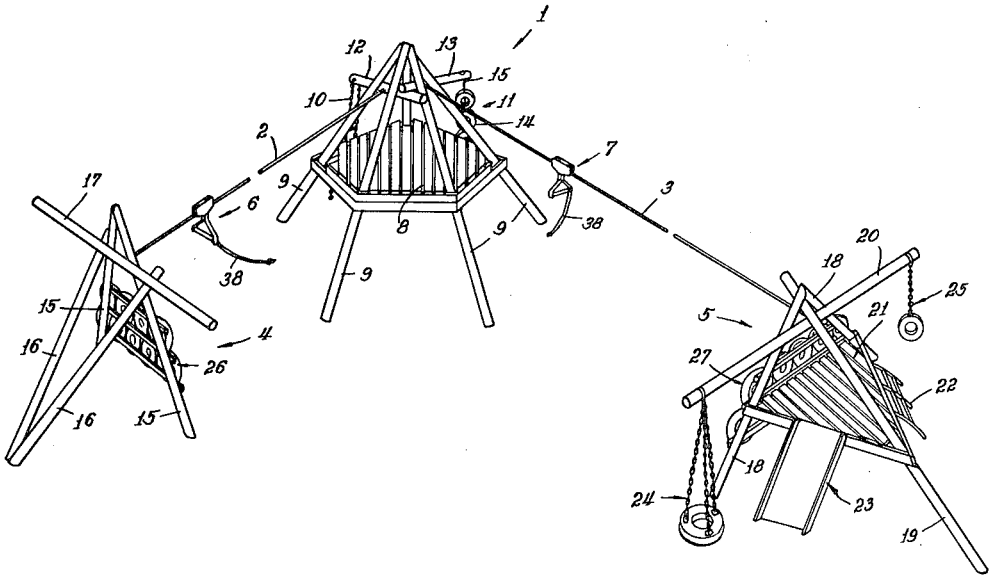

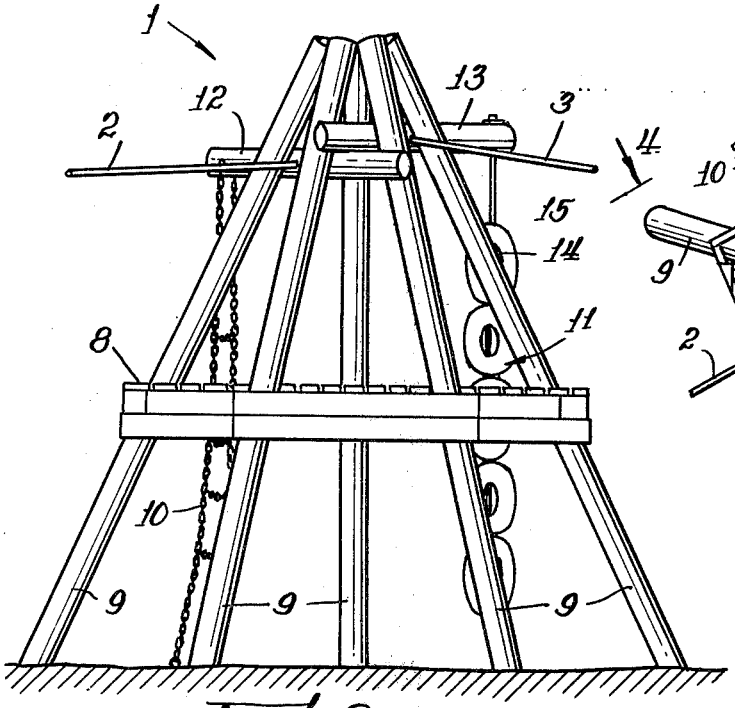
Fig. 2.
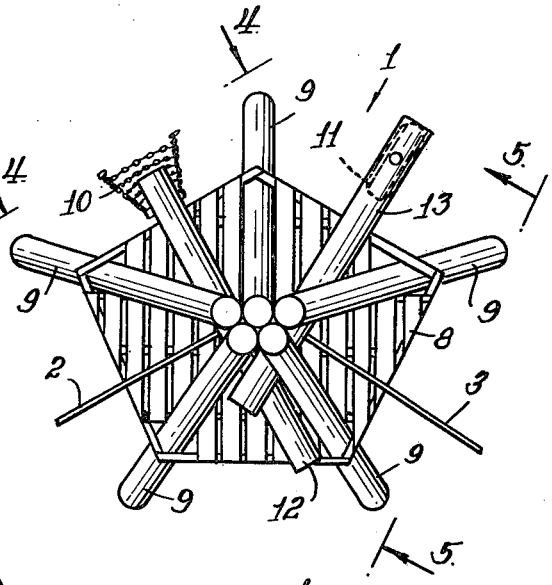
Fig. 3.
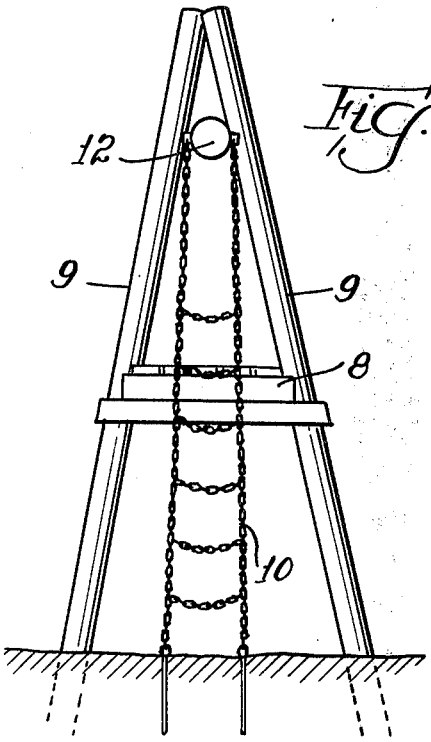
Fig. 4.
Fig. 5.
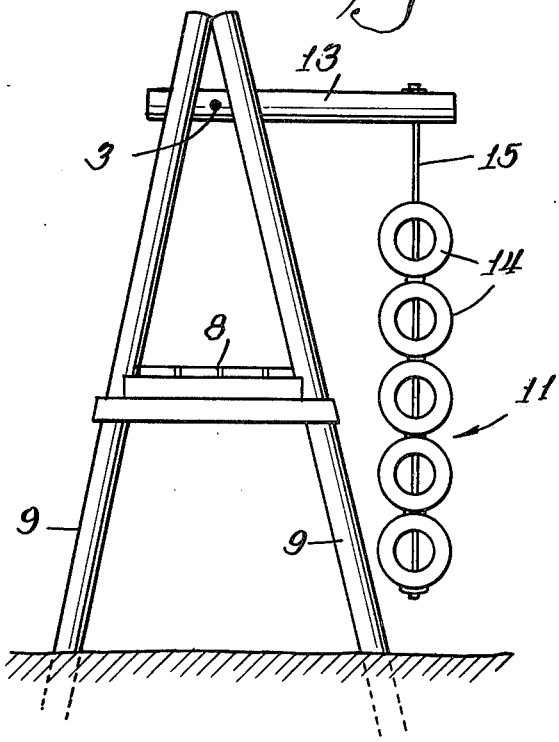

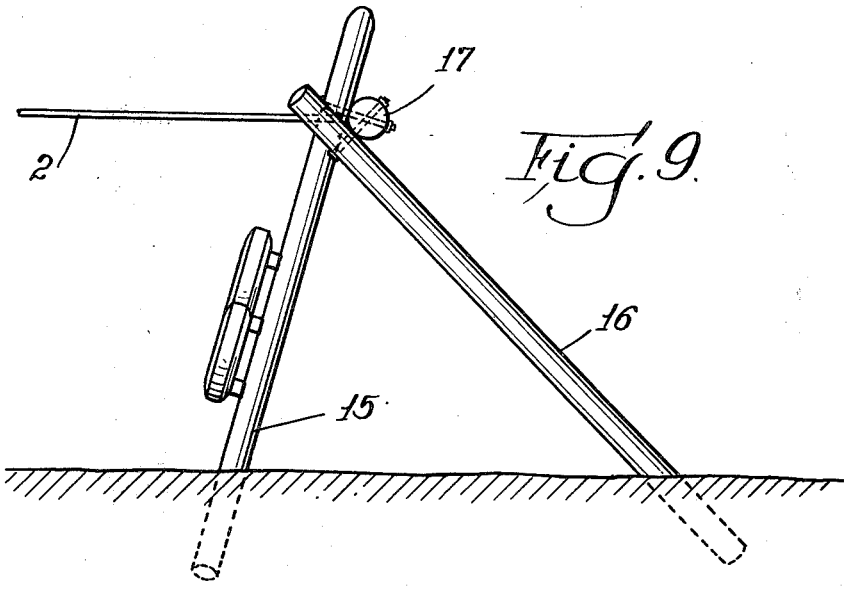
Fig. 9.
Fig. 10.
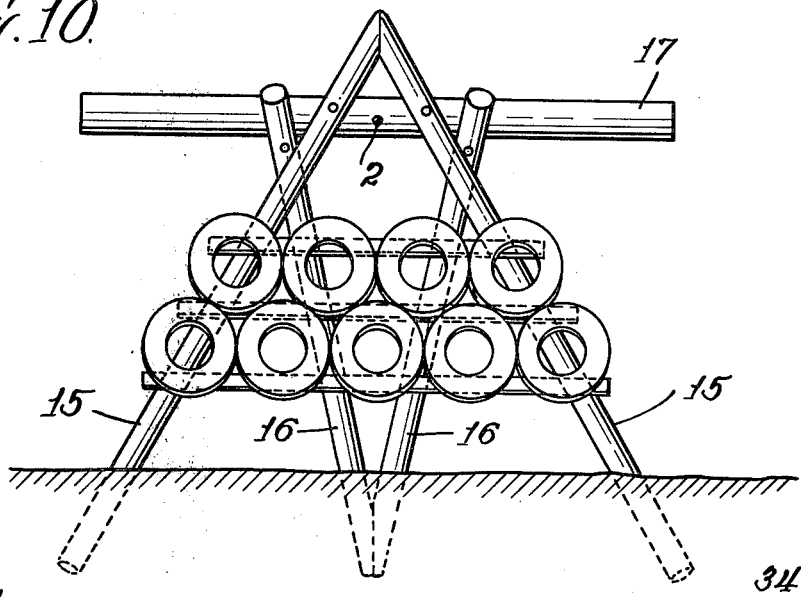
Fig. 11.
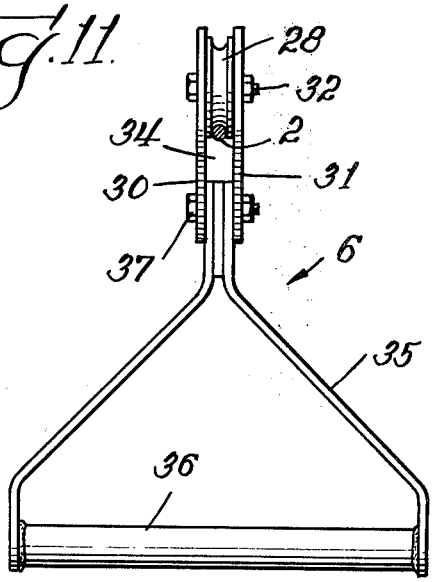
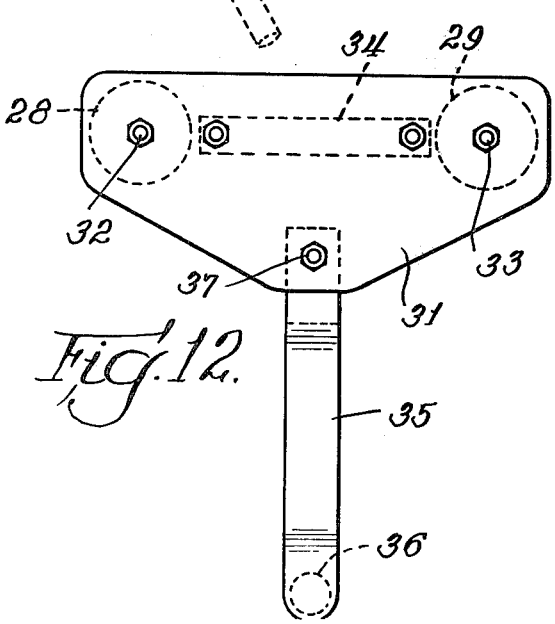
Fig. 12.

CHILD RECREATION STRUCTURE

BACKGROUND AND SUMMARY OF THE INVENTION

The need of children for physical activity and development has resulted in the provision of a wide variety of playground equipment such as swings, slides, merry-go-rounds and the like. While such apparatus stimulates play, including physical activity, the limits of the notoriously short interest spans of children are quickly reached on playground equipment of this kind. In using a slide, for example, children soon weary of climbing the steps to the top and sliding down, even though they may try sliding in lying position after a few slides in sitting position, etc. Challenges are limited and quickly satisfied and the equipment loses its attraction to the child.

A careful study of the propensities of children vis-a-vis play equipment has indicated that conventional playground equipment does not satisfy the needs of children for mental as well as physical development. Having quickly met the challenge and accomplished the use of each available piece of equipment in turn, the child looks about for other adventures. Children's play is an arousal seeking behavior and children play for the stimulation that they receive, not just to burn up energy. The lack of complexity, that is, the inability of an apparatus to offer something of an order beyond its most obvious, basic function, is believed to be the primary deficiency of the traditional slide, seesaw, etc. Intriguing novelty, imagination stimulating complexity and challenge that will not be denied are lacking in such conventional equipment.

The object of the invention herein described is to provide play apparatus which is intriguing to children because it provides a thrilling ride and which is challenging to a relatively broad age group because its use requires both "nerve" and physical coordination skills. An interrelated object is to provide self-operating means to limit access to the apparatus to those children having sufficiently developed motor skills to safely ride the cable passenger pulley.

More specifically, the object of the invention is to provide a cable slide sloping from a starting platform downwardly to a terminal tower which is provided with a cushion to absorb the impact of a child still moving at the end of the slide. A chain or tire ladder or other device that can be climbed or otherwise negotiated only with some difficulty provides the only access to the starting platform. A terminal tower may also be equipped with a platform for spectators and also with simple recreational apparatus, such as swings, which offer contentment while watching other children perform on the cable slide or awaiting a turn.

The form of the structure and the manner in which these objectives are achieved will become apparent as the detailed description of the invention proceeds.

DESCRIPTION OF THE DRAWINGS

In the accompanying drawings,

FIG. 2 is a front elevational view of the starting platform of the cable slide of FIG. 1;

FIG. 3 is a plan view of the starting platform;

FIG. 4 is a slide view of the starting platform taken at the line 4—4 of FIG. 3 and showing the chain ladder;

FIG. 5 is a side view of the starting platform taken at the line 5—5 of FIG. 3 and showing the tire ladder;

FIG. 9 is a side view of the terminal tower shown at the left hand side in FIG. 1;

FIG. 10 is a front elevational view of the terminal tower of FIG. 9, and

FIGS. 11 and 12 are front and side views, respectively, of the passenger pulley.

DESCRIPTION OF PREFERRED EMBODIMENT

Figure 1:
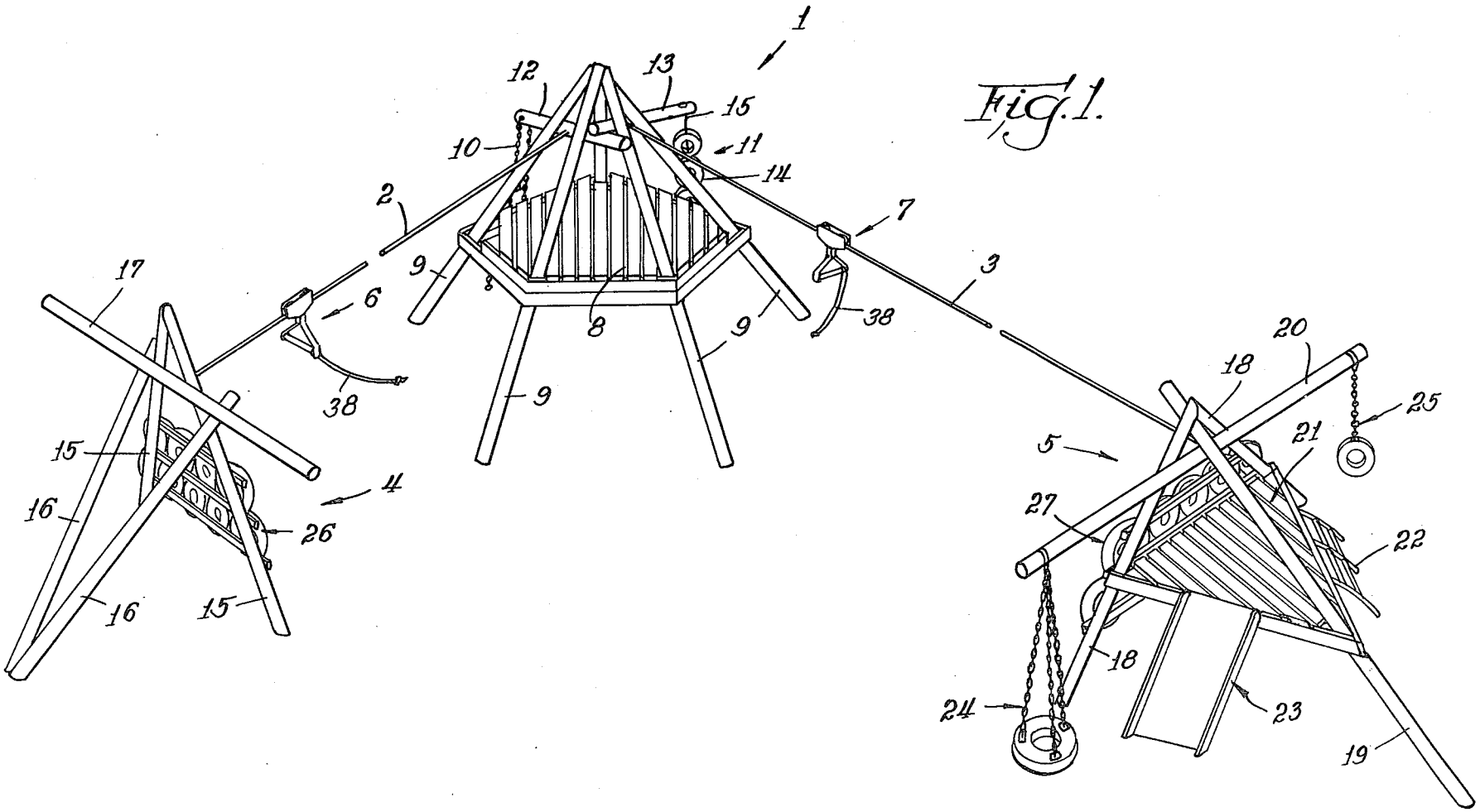
FIG. 1 is a perspective view of a two way cable slide embodying the invention.
Figure 6:
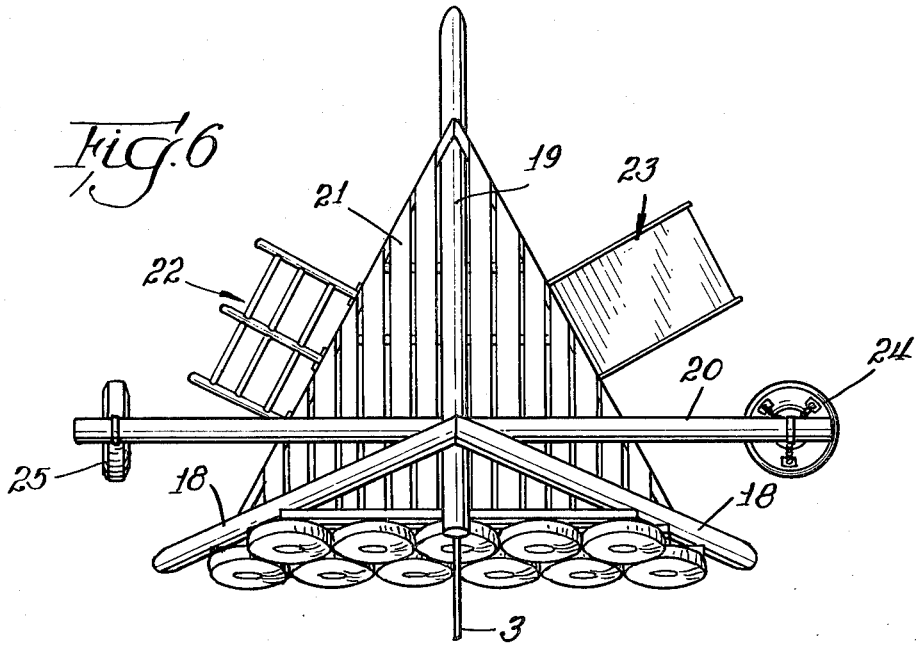
FIG. 6 is a plan view of the terminal tower shown on the right hand side of FIG. 1.
Figure 7:
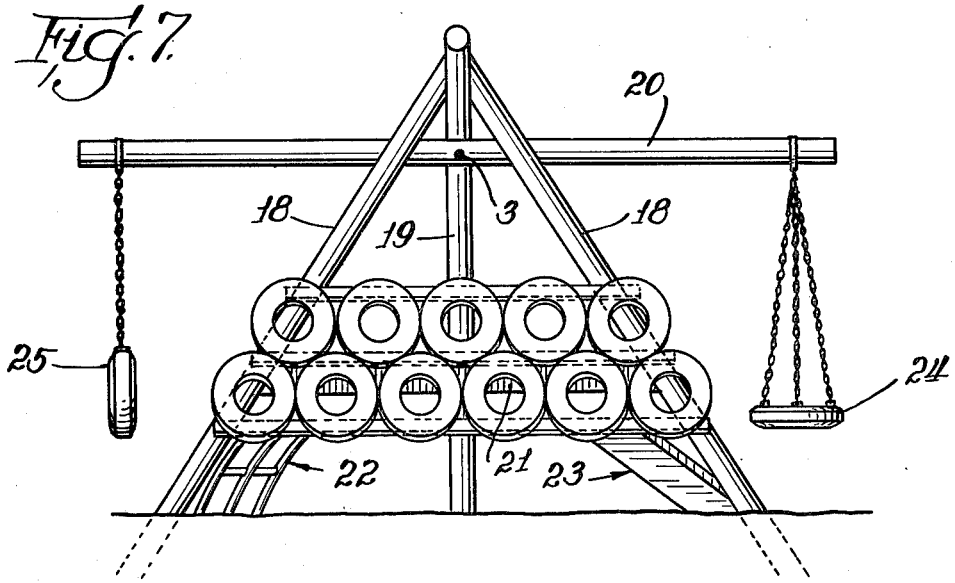
FIG. 7 is a front elevational view of the terminal tower of FIG. 6.
Figure 8:
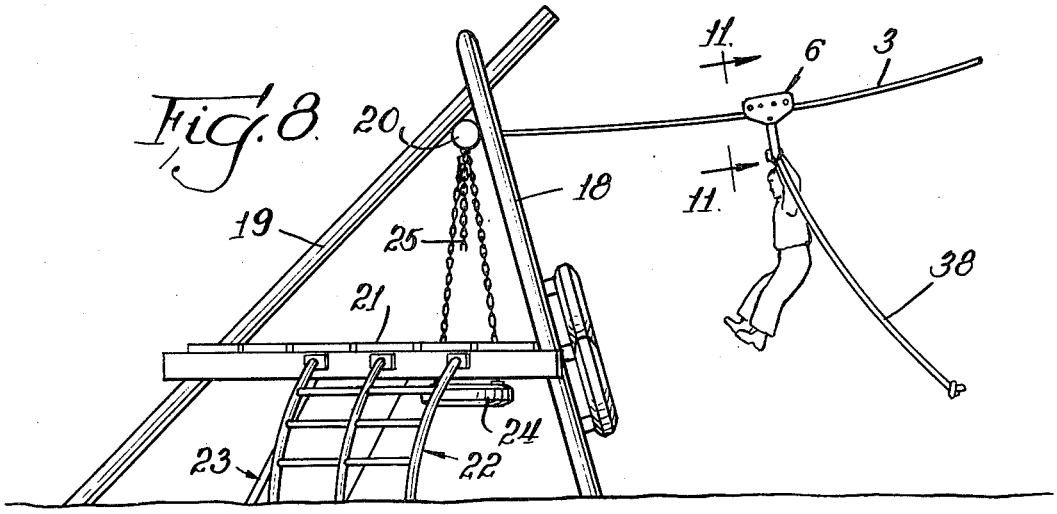
FIG. 8 is a side view of the terminal tower of FIG. 6.

A perspective view of a preferred embodiment of the invention is shown in FIG. 1. It provides a pair of cable slides, both starting from starting platform 1. Cables 2 and 3 have their starting ends firmly anchored near the top of the starting platform and their terminal ends are respectively firmly anchored near the tops of terminal towers 4 and 5, respectively. Passenger pulleys 6 and 7, more fully described hereinafter, are respectively arranged to roll along cables 2 and 3, respectively.

Starting tower 1 comprises a starting platform 8 which is fastened to the tower frame composed of five poles 9 well anchored in the ground, arranged tepee fashion and fastened together at the apex of the frame. The platform is supported at a height, e.g., six feet, which requires a child to climb or use ladder or other means to get up to the platform.

Although any type of ladder or other means for a child to climb to the starting platform may be employed, starting tower 1 is equipped with a chain ladder 10 and a tire ladder 11. The ladders are supported from the respective ends of crossbeams 12 and 13 each of which is securely fastened to a pair of poles 9. Preferably, the chain ladder is anchored to the ground at its bottom end. The tire ladder is formed by a series of used automobile tires 14 strung upon a cable 15, a cable clamp being secured to the cable at the inner surface at the top of each tire.

As is best shown in FIGS. 2 and 3, cable 2 is secured to crossbeam 12 and cable 3 is secured to crossbeam 13. The finish end of cable 2 is supported by a terminal tower comprised of an A-frame formed by poles 15, struts 16 and a crossbeam 17. The cable is anchored to the crossbeam which is bolted or otherwise secured to the terminal tower structure.

The finish end of cable 3 is supported by another terminal tower. This tower is also constructed as an A-frame composed of poles 18, strut 19 and crossbeam 20. The cable is anchored to the crossbeam.

The cable 3 terminal tower is designed to provide auxiliary recreation for children playing on the cable slide recreational equipment. A platform 21 is built upon and supported by the tower frame and an arch ladder 22 provides one way to climb to the platform and slide 23 provides a fun way to get back to the ground. Tire swings 24 and 25 are supported from the respective ends of crossbeam 20.

Platform 21 provides a vantage point for spectators to watch children as they ride the cable slide. It is available to children who are too young to ride the slides or who are awaiting their opportunity for a turn. The swings also provide entertainment for children waiting until the intensity of use of the cable slides subsides sufficiently to give them an opportunity to participate.

Weather and wear resistant cushions 26 and 27 are provided for absorbing the mild impact of the cable slide riders when they reach the terminal towers. They are composed of an array of used tires mounted upon supporting strips which are secured to the posts of the A-frame.

The passenger pulleys are shown in detail in FIGS. 11 and 12. Two pulley wheels 28 and 29 are mounted between side plates 30 and 31 by means of suitable pins 32 and 33. A spacer 34, bolted in place between the side plates, provides the necessary clearance for the free rotation of the pulley wheels. A handle 35 having a handlebar 36 which is long enough to accommodate both hands of a child is fastened to the slide plate structure by bolt 37. A pulley return cord 38, long enough to be reached by a child on the ground, is fastened to each passenger pulley for towing or whipping the pulley to a child on the starting platform.

Each part of the recreation structure herein described is designed to serve a contributing part in the activity pattern of the integrated system. The needs of children awaiting their turns to ride the cable slide and of those still too young to participate must be satisfied if the structure is to reach its full potential of providing developmental recreation. At the same time, would-be riders must be screened to limit use of the cable slides to those sufficiently developed to be able to ride safely. The structure system herein described provides such screening automatically.

I claim:

1. An integrated child recreation structure comprises starting and terminal towers and an overhead cable anchored to and held taut between said towers, a passenger pulley arranged to roll along said cable and having a handle depending therefrom, said starting tower having a platform mounted thereon at a level high enough to require access means for reaching said platform from the ground, and access means for reaching said platform from the ground, said means comprising only structure which is negotiable only by children having motor skills that are sufficiently developed to ensure safe use of said passenger pulley, said structure comprising a crossbeam mounted near the top of said starting tower, and flexible ladder means hung from an end of said crossbeam.

2. Structure in accordance with claim 1 wherein the flexible ladder means comprises a chain ladder.

3. An integrated child recreation structure comprises starting and terminal towers and an overhead cable anchored to and held taut between said towers, a passenger pulley arranged to roll along said cable and having a handle depending therefrom, said starting tower having a platform mounted thereon at a level high enough to require access means for reaching said platform from the ground, and access means for reaching said platform from the ground, said means comprising only structure which is negotiable only by children having motor skills that are sufficiently developed to ensure safe use of said passenger pulley, said terminal tower having an impact cushion mounted thereupon below and confronting said cable.

4. Structure in accordance with claim 3 wherein the impact cushion comprises an array of used vehicle tires supported in a plane upon the terminal tower.

5. An integrated child recreation structure comprises starting and terminal towers and an overhead cable anchored to and held taut between said towers, a passenger pulley arranged to roll along said cable and having a handle depending therefrom, said starting tower having a platform mounted thereon at a level high enough to require access means for reaching said platform from the ground, and access means for reaching said platform from the ground, said means comprising only structure which is negotiable only by children having motor skills that are sufficiently developed to ensure safe use of said passenger pulley, said structure comprising a crossbeam mounted near the top of said starting tower, and a tire ladder hung from an end of said crossbeam.

* * * * *